US006562534B1

(12) United States Patent
De Meutter et al.

(10) Patent No.: US 6,562,534 B1
(45) Date of Patent: May 13, 2003

(54) TONER COMPOSITION

(75) Inventors: Stefaan De Meutter, Oostakker (BE); Lode Deprez, Wachtebeke (BE); Dirk Gijsbrechts, Melsele (BE)

(73) Assignee: Xeikon N.V., Mortsel (BE)

( * ) Notice: Subject to any disclaimer, the term of this patent is extended or adjusted under 35 U.S.C. 154(b) by 0 days.

(21) Appl. No.: 09/974,767

(22) Filed: Oct. 9, 2001

(30) Foreign Application Priority Data

Oct. 13, 2000 (GB) ..... 0025200

(51) Int. Cl.[7] ..... G03G 9/087; G03G 13/20

(52) U.S. Cl. ..... 430/108.2; 430/109.1; 430/124

(58) Field of Search ..... 430/108.2, 108.4, 430/108.1, 111.4, 109.1, 124

(56) References Cited

U.S. PATENT DOCUMENTS 5,143,812 A * 9/1992 Mori et al. ..... 430/124
6,071,664 A * 6/2000 Tavernier et al. ..... 430/109

* cited by examiner

*Primary Examiner*—John Goodrow
(74) *Attorney, Agent, or Firm*—Knobbe Martens Olson & Bear LLP

(57) ABSTRACT

A toner composition is provided wherein by adding aliphatic lower molecular weight compounds which are partly or completely compatible with the binder resin(s), the melt viscosity of the toner composition can be lowered while the glass transition temperature (Tg) is more or less constant. Inclusion of these adding aliphatic lower molecular weight compounds, having a number average molecular weight, as measured by GPC in toluene, of from 500 to 3,000, results in toner compositions with a better adhesion and gloss and still an acceptable level of FOT and hot-offset. Also provide is a method for fixing toner images on a substrate.

12 Claims, No Drawings

TONER COMPOSITION

FIELD OF THE INVENTION

The present invention relates to a toner composition, especially to toner particles useful in eletrostatographic or magnetographic imaging methods wherein the toner particles are fixed to the final image-receiving member by application of heat or heat and pressure.

BACKGROUND OF THE INVENTION

In imaging methods such as electro(photo)graphy, magnetography, ionography, a latent image is formed that is developed by attraction of toner particles. In direct electrostatic printing, the toner particles are image-wise deposited on a substrate.

Toner particles are basically polymeric particles comprising a polymeric resin as main component and various ingredients mixed with the toner resin. Apart from colourless toners, which are used e.g. for finishing functions, the toner particles comprise at least one black and/or coloured substance, i.e. pigment.

In the different imaging methods, described above, the toner particles can be present in a liquid or in a dry developer composition. An advantage of using a dry developer composition instead of a liquid one resides in the absence of the need to eliminate the liquid phase after development. The avoidance of the need to evacuate (mainly organic) liquids may be desirable both from an economical standpoint and from an ecological standpoint.

After development of the latent image the developed image is transferred to a substrate directly or via one or more intermediate image-carrying members. In direct electrostatic printing the toner image may be deposited directly on the substrate or alternately on an intermediate image-carrying member and subsequently transferred to the substrate directly or via one or more intermediate image-carrying members.

The visible image, on this substrate, of electrostatically or magnetically attracted toner particles is not permanent and has to be fixed by causing the toner particles to adhere to each other and the substrate by softening or fusing them followed by cooling. Normally fixing proceeds on more or less porous paper by causing or forcing the softened or fused toner mass to penetrate into the surface irregularities of the paper.

There are different types of fixing processes used for fixing a toner powder image to a substrate. Some are based upon fixing primarily on fusing by heat, others are based on softening by solvent vapours, or by the application of cold flow using high pressure at ambient temperature.

In the fixing processes based on heat, two major types should be considered, the "noncontact" fixing process and the "contact" fixing process. In the non-contact fixing process, there is no direct contact of the toner image with a solid heating body. In a "contact" fixing process the substrate carrying the non-fixed toner image is conveyed through the contact zone formed by establishing pressure contact between a heated fixing member and a backing member while the substrate carrying the toner images passes in-between. Both the heated fixing member as well as the backing member may be in the form of a belt or a roller. The backing member may be heated too to avoid strong loss of heat within a copying cycle or to enable duplex fusing. This process has been employed widely in low-speed as well as high-speed fusing systems, since a remarkably high thermal efficiency is obtained because the surface of the heated fusing member is pressed against the surface of the substrate carrying the toner images to be fixed.

Another "contact" fixing process is the transfuse process where the toner image is not formed or transferred directly to the substrate and fixed there, but is first transferred, optionally via one ore more intermediate image-carrying members to a transfusing member, from where it is further, in one step, transferred and fixed to the substrate. As the transfuse process is usually executed at temperatures of 140 degrees Centigrade or below, low temperature feasibility of the toner is also a requirement.

Both contact fixing processes have to be monitored carefully in that when the fusing or transfuse member provide too much thermal energy to the toner and substrate, the toner will melt to a point where its melt cohesion and melt viscosity is so low that "splitting" will occur, and some of the toner is transferred to the fusing member. The toner present on the fusing member may be transferred back in a subsequent cycle of the fusing member to the substrate where it may disturb other images. Such a phenomenon is called "hot-offset". In order to avoid this phenomenon the toner particles have to be designed for a contact fusing process.

Both non-contact and contact fusing toners may be exposed to severe mechanical stress, e.g. during mixing, transport through the devices, by doctor blades, etc. Moreover as the transfer efficiency is usually not 100% but somewhat below, any residual toner image present on an image-delivering member, being an image-forming member such as e.g. a photoconductor, or an intermediate image-carrying member, has to be removed because otherwise the image quality of any subsequently formed or transferred images may be seriously disturbed. This residual image has to be removed within each cycle of the image-delivering member, being before re-entering into the development zone in case of an image forming member or before re-entering into the transfer zone in case of an intermediate image transfer member. Otherwise, this could lead to serious image defects because of mixing up of the new developed or transferred image with the residual image. This cleaning action is executed by a cleaning station positioned downstream the transfer zone. A cleaning station usually comprises a revolving brush and/or a scraper blade and/or other cleaning means, which can be engaged against the image-delivering member for removing residual toner therefrom. It is known that any cleaning means relying at least partly on mechanical forces to perform the cleaning, may result in filming on the image-delivering member due to smeared out toner particles. In case of an image-delivering member such as e.g. a photosensitive belt or drum, this filming may influence the level of chargeability amongst others resulting in a decreased image density of the final printed image. In case the image delivering member is an intermediate image transfer member this filming may negatively influence the surface properties of the image transfer member which directly affect the transfer properties leading to transfer efficiency degradation and deterioration of the overall image quality. Filming may be one of the failure mechanisms limiting lifetime of such an image-delivering member. Another failure mechanism may be the formation of defects such as micro-cracks and/or scratches on the surface of the image-delivering member during handling, introduction in the printing system, or after extended use. Compressed toner particles and other extraneous matter may accumulate on these defects. Both filming as well as accumulated toner/ extraneous matter is further referred to in this disclosure as fused-on-toner (FOT). Therefore, regardless of the type of fixing process, the toner particles have to be strong enough to withstand the mechanical stresses and avoid FOT.

Some further specifications a toner has to meet are a good adhesion to the substrate and a high gloss capability. To improve the feasibility of a toner, and more particularly the binder resin(s), it is beneficial to lower the viscosity of the resin(s) at softening/melting temperature in order to provide a larger contact area between the softened/melted toner and the substrate to thereby improve adhesion. A possible approach to accomplish this could be by lowering the glass transition temperature (Tg) and the molecular weight of the binder resin(s) of the toner. However, if the Tg and molecular weight of the binder resin are simply lowered, the above mentioned hot-offset is liable to occur. Moreover, the obtained binder resins are not strong enough to avoid or limit FOT and to withstand the mechanical stresses.

Several propositions have been made in the art. Thus, it has been disclosed, in e.g. EP 438181, EP 495475, EP 495476, U.S. Pat. Nos. 4,386,147, 5,853,940 and WO 98/29783, to mix low molecular weight resins with high molecular weight or cross-linked resins in order to combine the low-temperature feasibility with the anti-"hot-offset" characteristic and resistance to FOT and mechanical stresses. However it is observed that by increasing the amount of low molecular weight resin in order to obtain a higher gloss and better adhesion, hot-offset and lack of resistance to FOT and mechanical stress still occurs.

SUMMARY OF THE INVENTION

It is an object of the invention to provide a toner composition which combines a good adhesion and high gloss capability, and which at the same time is strong enough to withstand FOT and mechanical stresses. When such toner composition is used in a contact-fixing process, it preferably has good anti-"hot-offset" properties.

It is another object of the present invention to provide a toner composition that combines good hot offset properties and a high resistance to FOT and mechanical stresses with low temperature feasibility. Such a toner is of particular interest when using a transfuse fixing process.

It is still another object of the invention to provide a toner composition that can be used in any imaging process that includes a non-contact or contact fixing process for fixing a toner image to a substrate.

A toner composition is provided wherein by adding aliphatic lower molecular weight compounds which are partly or completely compatible with the binder resin(s), the melt viscosity of the toner composition can be lowered while the glass transition temperature (Tg) is more or less constant. Inclusion of aliphatic compounds results in toner compositions with a better adhesion and gloss and still an acceptable level of FOT and hot-offset. Therefore, according to a first aspect of the invention, a toner composition is provided comprising at least a pigment and a homogeneous blend of at least a binder resin and an aliphatic compound, said blend having a toluene-soluble fraction of at least 90% containing from 2 to 30% of said aliphatic compound, and said aliphatic compound having a number average molecular weight, as measured by GPC in toluene, of from 500 to 3,000.

In a second aspect of the invention, a method is disclosed for fixing unfixed toner images on a substrate, wherein the unfixed toner images are composed of toner particles having a composition comprising at least a pigment and a homogeneous blend of at least a binder resin and an aliphatic compound, said blend having a toluene-soluble fraction of at least 90% containing from 2 to 30% of said aliphatic compound, and said aliphatic compound having a number average molecular weight, as measured by GPC in toluene, of from 500 to 3,000, the method comprising the steps of:

urging a heated endless fixing member against an endless counter member thereby forming a fixing zone; and feeding the substrate through the fixing zone to thereby fix unfixed toner images to at least one side of said substrate.

DETAILED DESCRIPTION OF THE PREFERRED EMBODIMENTS

A toner composition is provided comprising at least a pigment and a blend of at least a binder resin and a lower molecular weight component, the blend having a toluene-soluble fraction of at least 90% containing from 2 to 30%, preferably from 2 to 20%, of the lower molecular weight component, and the lower molecular weight component having a number average molecular weight, as measured by GPC in toluene, of from 500 to 3,000. It is observed that the molecular weight of the lower molecular compound is lower than 500, the Tg drop is too high and with a molecular weight of more than 3,000 the viscosity drop is too small. It has been surprisingly found that the toner composition according to this invention, have a much lower viscosity and still a high Tg and good mechanical strength. It is further observed that when using concentrations of more than 30% of the lower molecular weight component, a portion of the lower molecular weight component is not sufficiently distributed through the binder resin(s).

Molecular weights referred to herein are obtained by GPC and are measured under the following conditions. 10 mg of the toner is mixed with 10 ml decalin and after 15 min shaking the solution is filtrated over a Millex filter 0.45 $\mu$m. Measurement conditions for molecular weight distribution:

Injection volume: 100 $\mu$l

Column: mixed bed column MIXED B (trade name of Polymer Labs)

Column temperature: 25° C.

Solvent: decalin

Flow: 1.5 ml/min (3000 psi)

The calibration of the GPC apparatus is done using several mono-disperse polystyrene standard samples.

The melt viscosity of the toner composition is preferably from 10 to 1000 Pa s, more preferably from 10 to 500 Pa s, measured at 100 rad/s at 120° C. The melt viscosity of the toner composition is measured using a CARRI-MED Rheometer CSL-500 (trade name of TA Instruments) with a 2.5 cm plate/plate geometry. The melt viscosity of the toner is measured between 100° C. and 180° C. with a constant strain of 5% and 1 Hz.

The glass transition temperature Tg of the toner composition is preferably at least 55° C. The Tg in the present invention is measured according to ASTM E 1356-91 and using a differential scanning calorimeter DSC 2920 (trade name of TA Instruments) at a heating rate of 10° C./min and under a $N_2$ flow of 50 ml/min. The inflection point is regarded as the Tg.

In a preferred embodiment of the invention, the blend of the binder resin and the lower molecular weight component is a homogeneous blend. A homogeneous blend is defined as a blend in which the amount of crystalline lower molecular weight component visible in a DSC plot of the composition is less than 60%, based on the weight of the lower molecular weight component, preferably less than 40%. The fraction (in weight percent) of crystalline lower molecular weight component is calculated by the formula (A/B)*100/C, where A=the melt enthalpy of the lower molecular weight component in the DSC-plot per unit mass of the toner composition, B=the melt enthalpy per unit mass of the pure lower molecular weight component and C=the weight percent of the lower molecular weight component in the toner composition. The amount of crystalline lower molecular weight component in the toner composition is preferably from 0.5% to 10% by weight. It is observed (see also Tables 1 and 2) that a crystalline fraction of the lower molecular weight component above 60% is detrimental with respect to FOT. FOT (fused-on-toner) includes both filming as well as other accumulated toner-based matter present on the outer surface of an image-delivering member. An example of such an image-delivering member is a photoconductive drum or belt as used in an electrographic imaging system such as a printing or copying system.

Preferably, the lower molecular weight component comprises an aliphatic compound. More preferably, the aliphatic compound is a long chain alkyl compound with formula (I):

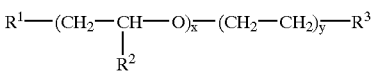

(I)

wherein $0 \leqq x \leqq 12$, $15 \leqq y \leqq 150$ and $R^1$ is a member selected from the group consisting of

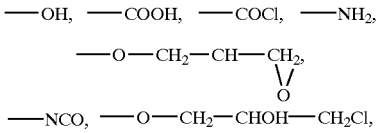

—COO—$CH_2$—CHOH—$CH_2Cl$ and COOM (where M is an alkali metal ion), $R^2$ is $CH_3$ or H, and $R^3$ is either $C_2H_5$ or $CH_3$.

Inclusion of a long chain alkyl compound in the toner composition results in toner images with a very good adhesion. With concentrations of more than 10% of the aliphatic compound a large portion of the aliphatic compound is not molecularly distributed what leads to FOT. With concentrations lower as 1% aliphatic compound the viscosity drop of the resin is too small.

The long chain alkyl compound has a number average molecular weight of between 500 and 2,000 and a ratio Mw/Mn of at most 3.

Examples of aliphatic compounds, are long chain alkyl compounds, commercially available as POLYWAX 500, POLYWAX 850, POLYWAX 1000, POLYWAX 2000, POLYWAX 3000, (trade names of PETROLITE, 6910 East 14th street, TULSA, Okla. 74112, USA), or polyolefinic mono-alcohols, commercially available as UNILIN 425, UNILIN 550, UNILIN 700 of the same PETROLITE company, or UNITHOX 720, a trade name for a hydroxy-terminated, polyolefinic-polyoxyethylenic macromolecule, with average molecular weight of 875 of the same PETROLITE company, or UNICID 700 a trade name of PETROLITE for a polyolefinic mono-carboxylic acid with average molecular weight of 700.

The homogeneous blend preferably contains at least 50%, most preferably from 50% to 96%, of the binder resin and the binder resin has a weight average molecular weight ($M_W$), as measured by GPC in toluene, of between 5,000 and 3,000,000, such as between 5,000 and 50,000. More preferably, the binder resin has a weight average molecular weight, as measured by GPC in toluene, of between 5,000 and 50,000.

In a preferred embodiment of the invention, the toner composition comprises a polyolefin binder resin containing at least one cyclic structure. Toner compositions comprising polyolefin resins or resin blends, see also EP978766 (assigned to Ticona) which is hereby incorporated by reference, are believed to be fixable at lower temperatures while having good anti-offset properties. Examples of polyolefin resins with cyclic structures, mono-modal and bimodal ethylene/norbornene copolymers, commercially available as TOPAS TM and TOPAS TB (trade name of Ticona). Until now, a disadvantage of this type of binder resins was their inherent bad adhesion properties (see also Tables 1 and 2). However, according to the present invention, the adhesion can be significantly improved by the addition of long chain alkyl compound, even at lower temperatures. This makes the toners according to the present invention also particularly suitable for use in transfuse fixing systems, where the fixing temperature is typically 140° C. or below. Preferably, the polyolefin resin has a weight average molecular weight, as measured by GPC in toluene, of between 5,000 and 50,000. Alternatively, the polyolefin resin comprises a first fraction having a weight average molecular weight, as measured by GPC in toluene, from 50,000 to 1,000,000, and a second fraction having a weight average molecular weight, as measured by GPC in toluene, from 5,000 to 20,000.

The toner composition will usually be in the form of dry toner particles, each comprising both the binder resin and the lower molecular weight component, although the composition could equally form the basis of a liquid toner product.

The toner composition may further comprise any normal toner ingredients such as charge control agents, pigments (coloured and/or black), inorganic fillers, and fine magnetic material. A description of charge control agents, pigments and other additives useful in toner particles, can be found in EP601235.

The toner particles can be used as a mono-component dry developer (both magnetic and non-magnetic) or mixed with carrier particles to form a multi-component developer. The toner particles, when used in a multi-component dry developer, can be mixed with any known carrier material. Suitable carrier particles are carrier particles as disclosed in, e.g., EP289663; EP559250; EP656130 and EP898206. Known fluidity enhancers such as hydrophobized silica, can be mixed with the toner particles.

The toner particles can have an average volume diameter between 1 and 50 $\mu$m, preferably between 3 and 20 $\mu$m and more preferably between 3 and 10 $\mu$m. The particle size distribution of the toner particles can be of any type. It is however preferred to have a Gaussian or normal particle size distribution, either by number or volume, with a coefficient of variability (standard deviation divided by the average) (v) smaller than 0.5, more preferably of 0.3. The toner particles can have any shape. For instance, the particles may be irregular or rounded.

The toner composition may be prepared by mixing in a solvent the binder resin, the lower molecular weight component, and other components, and thereafter removing the solvent. The toner particles can be prepared by any method known in the art, but it is preferred to produce the toner particles by a melt kneading process at a temperature that is higher than the melting point $M_p$ of the resin binder.

There are different types of fixing processes which can be used for fixing toner particles formed from the toner compositions according to the present invention. Some are based upon fixation primarily on fusing by heat, others are based on softening by solvent vapours, or by the application of a cold flow with high pressure at ambient temperature.

The toner composition is especially useful for use in electrostatographic or magneto graphic imaging methods wherein the fixing proceeds in a "contact fusing" station.

Thus, according to a second aspect of the invention, a method is provided for fixing unfixed toner images to a substrate, wherein the unfixed toner images are composed of toner particles having a composition as described above and further specified in the appending claims related to the toner composition, the method comprising the steps of:

urging a heated endless fixing member against an endless counter member thereby forming a fixing zone; and feeding the substrate through the fixing zone.

The substrate can be in web or in sheet form. In the latter case, the substrate is preferably carried on a conveyer member. This conveyer member may constitute the endless counter member. Alternatively, particularly in case of a conveyor belt, the belt with the substrate attached thereto may be fed simultaneously through the fixing zone. Typical substrate materials are papers, films, label stock, cardboard etc.

The endless heated fixing member preferably comprises a fluorosilicone layer.

In an embodiment, the unfixed toner images are transferred to at least one surface of the substrate prior to being fed through the fixing zone. The substrate carrying the non-fixed toner image is conveyed through the nip formed by a heated fixing roller and a counter roller backing the substrate. This roller may be heated controllably, for instance to avoid strong loss of heat within a copying/printing cycle or to enable duplex fixing.

In another embodiment of the present invention, the unfixed toner images are carried on the heated endless fixing member so as to simultaneously transfer the unfixed toner images to and fix the unfixed toner images to a surface of the substrate. The fixing process described here is the so-called transfuse process where the toner image is not formed or transferred directly to the substrate and fixed there, but is first transferred, optionally via one ore more intermediate image-carrying members to a transfusing member, i.e. the heated endless fixing member, from where it is further, in one step, transferred and fixed to the substrate. The transfuse process is usually executed at temperatures of 140 degrees Centigrade or below.

Suitable top layers for transfuse members are top layers based on silicone elastomers, especially fluorosilicone top layers have an excellent balance between abhesivity and durability. The transfuse member may further comprise a backing layer composed of metal or fabric. The transfuse member may further comprise at least one conformable layer between the backing layer and the top layer. Thermal conductive fillers and/or electrical conductive fillers can be dispersed in the conformable layer.

The counter member is preferably a temperature controlled roller.

The invention also provides a method for dry fixing unfixed toner images on a substrate, comprising the steps of:

heating unfixed toner images on an endless fixing member to a temperature from 80 to 140° C., the fixing member having a fluorosilicone top layer, the unfixed toner images being composed of a toner composition with a Tg>55° C. and a melt viscosity from 10 to 500 Pa s, measured at 100 rad/s at 120 Centigrade degrees, and transferring and fixing the heated toner images to a surface of a substrate by urging the endless fixing member against an endless counter member while the substrate is fed therebetween.

EXAMPLES

Preparation of the Toner Particles

Toner 1

95 parts wt/wt of the polymer Topas TM 9808A (trade name) of Ticona were mixed with 5 parts by weight of a cyan Cu-phtalocyanine pigment. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 2

95 parts wt/wt of the polymer Topas TM 000107-S (trade name) of Ticona were mixed with 5 parts by weight of a cyan Cu-phtalocyanine pigment. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 3

90.25 parts wt/wt of the polymer Topas TM (trade name) of Ticona were mixed with 5 parts by weight of a cyan Cu-phtalocyanine pigment and 4.75 parts by weight of Unilin 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 4

85.5 parts wt/wt of the polymer Topas TM (trade name) of Ticona were mixed with 5 parts by weight of a cyan Cu-phtalocyanine pigment and 9.5 parts by weight of Unilin 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 5

94.05 parts wt/wt of the polymer Topas TM (trade name of Ticona) were mixed with 5 parts by weight of a cyan Cu-phtalocyanine pigment and 0.95 parts by weight of Unicid 700 (trade name of Petrolite) were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 6

92.15 parts wt/wt of the polymer Topas TM (trade name of Ticona) were mixed with 5 parts by weight of a cyan Cu-phtalocyanine pigment and 2.85 parts by weight of Unicid 700 (trade name of Petrolite) were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 7

95 parts wt/wt of the polymer Topas TB (trade name of Ticona) were mixed with 5 parts by weight of a cyan Cu-phtalocyanine pigment. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 8

95 parts wt/wt of the solvent blend of the polymers Topas TB/Topas TM000107-S 1/1 (trade name) of Ticona were mixed with 5 parts by weight of a cyan Cu-phtalocyanine pigment. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 9

95 parts wt/wt of the solvent blend of the polymers Topas TB/Topas TM000107-S 1/3 (trade name) of Ticona were mixed with 5 parts by weight of a cyan Cu-phtalocyanine pigment. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 10

85.5 parts wt/wt of the polymer Topas TB (trade name) of Ticona were mixed with 5 parts by weight of a cyan Cu-phtalocyanine pigment and 9.5 parts by weight of Unilin 450 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 11

93.1 parts wt/wt of the polymer Topas TB (trade name) of Ticona were mixed with 5 parts by weight of a cyan Cu-phtalocyanine pigment and 1.9 parts by weight of Unilin 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 12

90.25 parts wt/wt of the polymer Topas TB (trade name) of Ticona were mixed with 5 parts by weight of a cyan Cu-phtalocyanine pigment and 4.75 parts by weight of Unilin 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 13

88.35 parts wt/wt of the polymer Topas TB (trade name) of Ticona were mixed with 5 parts by weight of a cyan Cu-phtalocyanine pigment and 6.65 parts by weight of Unilin 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 14

85.5 parts wt/wt of the polymer Topas TB (trade name) of Ticona were mixed with 5 parts by weight of a cyan Cu-phtalocyanine pigment and 9.5 parts by weight of Unilin 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 15

85.5 parts wt/wt of the polymer Topas TB (trade name) of Ticona were mixed with 5 parts by weight of a cyan Cu-phtalocyanine pigment and 9.5 parts by weight of Unilin 2000 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 16

90.25 parts wt/wt of the polymer Topas TB (trade name) of Ticona were mixed with 5 parts by weight of a cyan Cu-phtalocyanine pigment and 4.75 parts by weight of Unicid 700 (trade name of Petrolite) were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 17

85.5 parts wt/wt of the polymer Topas TB (trade name) of Ticona were mixed with 5 parts by weight of a cyan Cu-phtalocyanine pigment and 9.5 parts by weight of Unicid 700 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

Toner 18

85.5 parts wt/wt of the polymer Topas TB (trade name) of Ticona were mixed with 5 parts by weight of a cyan Cu-phtalocyanine pigment and 9.5 parts by weight of Polywax 1000 (trade name) of Petrolite were added. The mixture was melt homogenised at 130° C., cooled and pulverised, classified to give cyan toner particles volume average diameter $d_{v50}$ of 7.2 μm, as determined by COULTER COUNTER (trade name), and numerical average diameter $d_{n50}$ of 5.7 μm.

An overview of the physical properties of Toners 1 to 18 is given in the following Table 1.

TABLE 1

| Toner | GPC $M_w$ peaks in toluene of the binder resin(s) | | Crystalline | Tg | Viscosity [Pa s] | |
|---|---|---|---|---|---|---|
| No. | 1 | 2 | fraction | (° C.) | at 120° C. | at 140° C. |
| 1 | 10.700<br>100% | | | 67 | 1440 | 165 |
| 2 | 7,000<br>100% | | | 64 | 305 | 49 |
| 3 | 10.700<br>100% | | | 64 | 277 | 57 |
| 4 | 10.700<br>100% | | | 63 | | |
| 5 | 10.700<br>100% | | 27% | 64 | 1079 | 130 |
| 6 | 10.700<br>100% | | 58% | 63 | 600 | 93 |
| 7 | 9,000<br>90% | 350,000<br>10% | | 68 | 725 | 195 |
| 8 | 7,000<br>50% | 9,000<br>45% | | 66 | 594 | 108 |
| 9 | 7,000<br>75% | 9,000<br>22.5% | | 67 | 415 | 64 |
| 10 | 9,000<br>90% | 350,000<br>10% | | 55 | 144 | 52 |

TABLE 1-continued

| Toner | GPC $M_w$ peaks in toluene of the binder resin(s) | | Crystalline | Tg | Viscosity [Pa s] | |
|---|---|---|---|---|---|---|
| No. | 1 | 2 | fraction | (° C.) | at 120° C. | at 140° C. |
| 11 | 9,000 90% | 350,000 10% | 45% | 66 | | |
| 12 | 9,000 90% | 350,000 10% | 71% | 64 | 363 | 122 |
| 13 | 9,000 90% | 350,000 10% | | 63 | 293 | 107 |
| 14 | 9,000 90% | 350,000 10% | 79% | 63 | 167 | 65 |
| 15 | 9,000 90% | 350,000 10% | | 68 | 580 | 104 |
| 16 | 9,000 90% | 350,000 10% | | 63 | 578 | 160 |
| 17 | 9,000 90% | 350,000 10% | | 63 | 212 | 77 |
| 18 | 9,000 90% | 350,000 10% | | 65 | | |

Preparation of the Developer

A developer was prepared with these toner particles by adding 0.5% (wt/wt) of AEROSIL R812 (trade name of Degussa, Germany) hydrophobic silica and 0.5% (wt/wt) of T-805 hydrophobic titanium oxide and mixing the toner and silica/$TiO_2$ for 1 min in an MTI mixer.

5% wt/wt of the toner particles and silica/$TiO_2$ were further mixed with silicone-coated ferrite carrier particles with average volume particle diameter $d_{v50}$ of 50 $\mu$m.

Printing and Fixing Examples

The developers were used to produce images on a paper substrate in the X-35 copier (trade name of Agfa-Gevaert NV, Mortsel, Belgium). The images contained 0.5 mg of toner per $cm^2$. The images were fixed off-line in a transfuse set up. The toner image is transferred electrostatically to an endless transfuse belt, from where it is further, in one step transferred and fixed to the substrate. The transfusing member has a fluorosilicone top layer. Due to the abhesivity of the fluorosilicone top layer the image can be transferred to the substrate with only heat and pressure and without electrostatic forces. The fuser speed was 25 cm/sec.

After fixing, the images were evaluated on four topics:

(1) Adhesion window: fixing temperature window whereby the density-loss after abrasion of a folded toner image is less than 40% (not for oven fusing).

(2) Adhesion after fixing at fixed temperature:

Density of toner image=D1;

Density after abrasion of a folded toner image=D2;

$$\text{Adhesion value}=(D2/D1)\times 100.$$

(3) Gloss at 60° C. after fixing at fixed temperature.

(4) Hot-offset temperature.

FOT Experiments

With all the developers 30,000 A4 prints were made in a DCP-1 engine (trade name of Xeikon NV). FOT was evaluated on a scale of 4 to 1:4=very good, 3=good, 2=marginal, 1=unacceptable.

The results are summarised in Table 2.

TABLE 2

| Toner | Binder resin | Lower MW component | Adhesion window | Hot offset | Adhesion 120° C. | Gloss 120° C. | FOT |
|---|---|---|---|---|---|---|---|
| 1 | 100% Topas TM9808A | — | None | 140 | 53 | 5.4 | 4 |
| 2 | 100% Topas TM000107-S | — | None | 125 | 45 | 17.0 | 2 |
| 3 | 95% Topas TM9808A | 5% Unilin 700 | 115–125 | 125 | 71 | 15.7 | 3 |
| 4 | 90% Topas TM9808A | 10% Unilin 700 | 110–120 | 120 | — | — | 1 |
| 5 | 99% Topas TM9808A | 1% Unilin 700 | 110–130 | 130 | 60 | 12.8 | 4 |
| 6 | 97% Topas TM9808A | 3% Unilin 700 | 110–125 | 125 | 66 | 14.3 | 4 |
| 7 | 100% Topas TB | — | 150–170 | 170 | 46 | 1.7 | 4 |
| 8 | Solvent blend TB/TM 1/1 | — | 100–130 | 130 | 65 | 7.0 | 2 |
| 9 | Solvent blend TB/TM 1/3 | — | 100–125 | 125 | 73 | 9.0 | 2 |
| 10 | 90% Topas TB | 10% Unilin 450 | 100–135 | 135 | 84 | 10.5 | 1 |
| 11 | 98% Topas TB | 2% Unilin 700 | 145–170 | 170 | 50 | 4.2 | 4 |
| 12 | 95% Topas TB | 5% Unilin 700 | 120–155 | 155 | 57 | 5.8 | 3 |
| 13 | 93% Topas TB | 7% Unilin 700 | 110–150 | 150 | 60 | 7.6 | 2 |
| 14 | 90% Topas TB | 10% Unilin 700 | 100–150 | 150 | 75 | 9.5 | 1 |
| 15 | 90% Topas TB | 10% Unilin 2000 | 120–170 | 170 | 69 | 4.2 | 1 |
| 16 | 95% Topas TB | 5% Unicid 700 | 100–150 | 150 | 85 | 5.4 | 2 |
| 17 | 90% Topas TB | 10% Unicid 700 | 95-145 | 145 | 94 | 9.8 | 1 |
| 18 | 90% Topas TB | 10% Polywax 1000 | 100–140 | 140 | 76 | 11.0 | 3 |

What is claimed is:

1. A toner composition comprising at least a pigment and a homogeneous blend of at least one polyolefin binder resin and an aliphatic compound, said blend having a toluene-soluble fraction of at least 90% containing from 2 to 30% of said aliphatic compound, and said aliphatic compound having a number average molecular weight, as measured by GPC in toluene, of from 500 to 3,000.

2. The toner composition as claimed in claim 1, wherein said aliphatic compound is a long chain alkyl compound with formula (I):

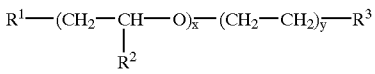

(I)

wherein $0 \leqq x \leqq 12$, $15 \leqq y \leqq 150$ and $R^1$ is a member selected from the group consisting of

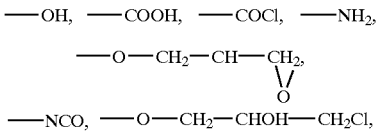

—COO—$CH_2$—CHOH—$CH_2Cl$ and COOM (where M is an alkali metal ion), $R^2$ is $CH_3$ or H, and $R^3$ is either $C_2H_5$ or $CH_3$.

3. The toner composition as in claim 2, wherein said long chain alkyl compound has a number average molecular weight of between 500 and 2,000 and a ratio Mw/Mn of at most 3.

4. The toner composition as in claim 2, wherein said toluene-soluble fraction of said blend comprises at least 50% of said polyolefin binder resin, said polyolefin binder resin having a weight average molecular weight, as measured by GPC in toluene, of between 5,000 and 3,000,000.

5. The toner composition as in claim 2, wherein said polyolefin binder resin has a weight average molecular weight, as measured by GPC in toluene, of between 5,000 and 50,000.

6. A toner composition comprising at least a pigment and a homogeneous blend of at least one polyolefin binder resin comprising at least one cyclic structure, and an aliphatic compound, said blend having a toluene-soluble fraction of at least 90% containing from 2 to 30% of said aliphatic compound, and said aliphatic compound having a number average molecular weight, as measured by GPC in toluene, of from 500 to 3,000.

7. The toner composition as claimed in claim 6, wherein said aliphatic compound is a long chain alkyl compound with formula (I):

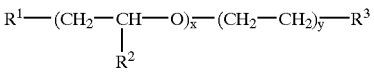

(I)

wherein $0 \leqq x \leqq 12$, $15 \leqq y \leqq 150$ and $R^1$ is a member selected from the group consisting of

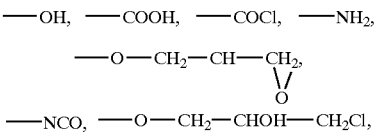

—COO—$CH_2$—CHOH—$CH_2Cl$ and COOM (where M is an alkali metal ion), $R^2$ is $CH_3$ or H, and $R^3$ is either $C_2H_5$ or $CH_3$.

8. The toner composition as in claim 6, wherein said polyolefin binder resin comprises a first fraction having a weight average molecular weight, as measured by GPC in toluene, of between 5,000 and 50,000.

9. The toner composition as in claim 6, wherein said polyolefin binder resin comprises a first fraction having a weight average molecular weight, as measured by GPC in toluene, from 50,000 to 1,000,000, and a second fraction having a weight average molecular weight, as measured by GPC in toluene, from 5,000 to 20,000.

10. A method for fixing unfixed toner images on a substrate, wherein said unfixed toner images are composed of toner particles comprising at least a pigment and a homogeneous blend of at least one polyolefin binder resin and an aliphatic compound, said blend having a toluene-soluble fraction of at least 90% containing from 2 to 30% of said aliphatic compound, and said aliphatic compound having a number average molecular weight, as measured by GPC in toluene, of from 500 to 3,000, said method comprising the steps of:

urging a heated endless fixing member against an endless counter member thereby forming a fixing zone; and feeding said substrate through said fixing zone.

11. The method as in claim 10, wherein said unfixed toner images are transferred to at least one surface of said substrate prior to being fed through said fixing zone.

12. The method as in claim 10, wherein said unfixed toner images are carried on said heated endless fixing member so as to simultaneously transfer said unfixed toner images to and fix said unfixed toner images on a surface of said substrate.

* * * * *